United States Patent [19]

Keller

[11] 4,379,368

[45] Apr. 12, 1983

[54] HOT AIR DRIER

[75] Inventor: A. Kent Keller, Mantorville, Minn.

[73] Assignee: Whey Systems, Inc., Mantorville, Minn.

[21] Appl. No.: 256,848

[22] Filed: Apr. 23, 1981

[51] Int. Cl.[3] ..... F26B 17/10

[52] U.S. Cl. ..... 34/57 R; 34/57 A; 34/57 D; 34/66

[58] Field of Search ..... 34/10, 57 A, 57 B, 57 C, 34/57 D, 57 R, 66; 432/15, 58; 110/245; 122/4 D; 406/135, 138

[56] References Cited

U.S. PATENT DOCUMENTS

| | | | |
|---|---|---|---|
| 2,835,050 | 5/1958 | Janetti | 34/173 |
| 3,780,445 | 12/1973 | Hansen | 34/57 D |
| 3,795,058 | 3/1974 | Ganiaris | 34/57 D |
| 3,889,388 | 6/1975 | Oguri et al. | 34/57 D |
| 4,253,824 | 3/1981 | Foote | 34/57 A |

*Primary Examiner*—Larry I. Schwartz
*Attorney, Agent, or Firm*—Dorsey & Whitney

[57] ABSTRACT

A hot air drier system for breaking up and drying particles or aggregates of moist material includes a preliminary drier unit with a moist solids inlet, a hot air inlet, and a dried solids outlet. A pneumatic conveying conduit receives solids from the outlet and subjects them to further drying while they are conveyed to a suitable separator. Hot air is supplied to the drier inlet through a supply conduit which has a bypass conduit for delivering fully heated air to the pneumatic conveying conduit close to the solids outlet and which also has a cooling air conduit or bypass for selectively feeding heated air of somewhat lower temperature to the drier inlet.

Details of a preferred drier unit include the relative location of the moist solids inlet directly above a hot air inlet at the bottom of the drier and with at least one sloping side wall of the drier inclined upwardly and outwardly to a solids outlet opening in the top wall at a location laterally offset from the vertical axis of the solids inlet and hot air inlet. Heated air from the air supply conduit is fed into a cylindrical plenum chamber below the bottom air inlet of the drier unit. A rotary rake member within the unit assists in breaking up and lifting moist particles dropping through the solids inlet toward the bottom air inlet. The rake member, drier cross-section, and upward flow of heated air recycle particles in the drier unit, until they are sufficiently broken up and dried for air classification and delivery through the solids outlet opening.

20 Claims, 5 Drawing Figures

HOT AIR DRIER

BACKGROUND OF THE INVENTION

The present invention relates to driers for particles and aggregates of moist solids, and is particularly adapted to the processing of wet solid materials in the food industry, such as the drying of milk sugar lactose as part of a whey production system. Various types of driers have been used for such purposes in the past. Typical installations have included either drum driers or fluid bed driers. Problems have been encountered in connection with prior processes of such types. In some cases, there has been a problem of proper temperature control to avoid damage to particular materials by sujecting them to too high a temperature or too long an exposure, such that the particles may be appropriately dried, but may be damaged by such handling. Difficulties have also been encountered in the handling and drying of moist solid aggregates of different sizes, where there is a risk of damaging finer particles which are more rapidly dried, as compared to larger or damper aggregates which may require longer drying times or higher drying temperatures in combination with some treatment assist in breaking up the larger aggregates.

Thus I have found a need for an improved drier unit and drier system which can be more easily operated and adjusted with less risk of damge to the sensitive materials to be processed and which has a relatively simple construction which is more economical to build than such prior installations.

SUMMARY OF THE INVENTION

The present invention accordingly provides an improved hot air drier for particles and aggregates of moist solids, in which the drier has a body portion with a bottom air inlet opening, a top wall spaced above the bottom air inlet opening, and a moist solids inlet opening in the top wall directly above the air inlet opening. The drier unit body also includes side wall portions extending upwardly from the edges of the bottom opening to the top wall and including at least one sloping side wall portion extending upwardly and outwardly from the bottom opening to an area of the top wall spaced laterally outwardly from the solids inlet opening, thereby defining a drying chamber of upwardly expanding cross section between the air inlet opening and the top wall. A solids outlet opening is provided in the laterally outwardly-spaced area of the top wall, a pneumatic air conveying and drying conduit extends from the solids outlet opening for conveying selected solids from the chamber, and the drier is connected to blower means for maintaining a primary flow of heated drying air upwardly through the bottom air inlet, the drying chamber, and the solids outlet opening and through the conveying conduit, at a volume rate providing air classification within the drier chamber and lateral lifting of at least partially dried and separated solids through the chamber and solids outlet opening, and dropping of undesirably moist and unseparated solids down through the chamber toward the bottom air inlet opening for recycling inside the drier, with preliminary or further drying and particle separation by the heated air entering that opening.

In its preferred embodiment, the drier body side wall portions define an asymmetrical drying chamber of upwardly expanding cross section in which the bottom inlet opening is generally circular with reference to a vertical axis extending through the solids inlet opening, and in which a perforated inlet plate extends across the bottom air inlet opening and is kept clear by a combination of upwardly flowing heated air entering the bottom inlet opening and a movable rake member supported on a vertical rotary rake shaft extending upwardly through the center of the inlet opening and perforated plate.

The invention further provides preferred shapes and relevant arrangements for the drier chamber side walls, for a preliminary plenum chamber for heated air below the bottom inlet opening, for the selective delivery of heated air at moderate temperature to the bottom inlet opening and of heated air at higher temperature to the pneumatic conveying conduit close to the solids outlet of the drier chamber, as well as constructional features for cooling the necessary bearings for the rotary rake member.

Other features and advantages of the invention will be apparent from the following more detailed description.

BRIEF DESCRIPTION OF THE DRAWINGS

In the drawings which form a part of this application, and in which like reference characters indicate like parts.

DESCRIPTION OF THE PREFERRED EMBODIMENTS

Figure 1:
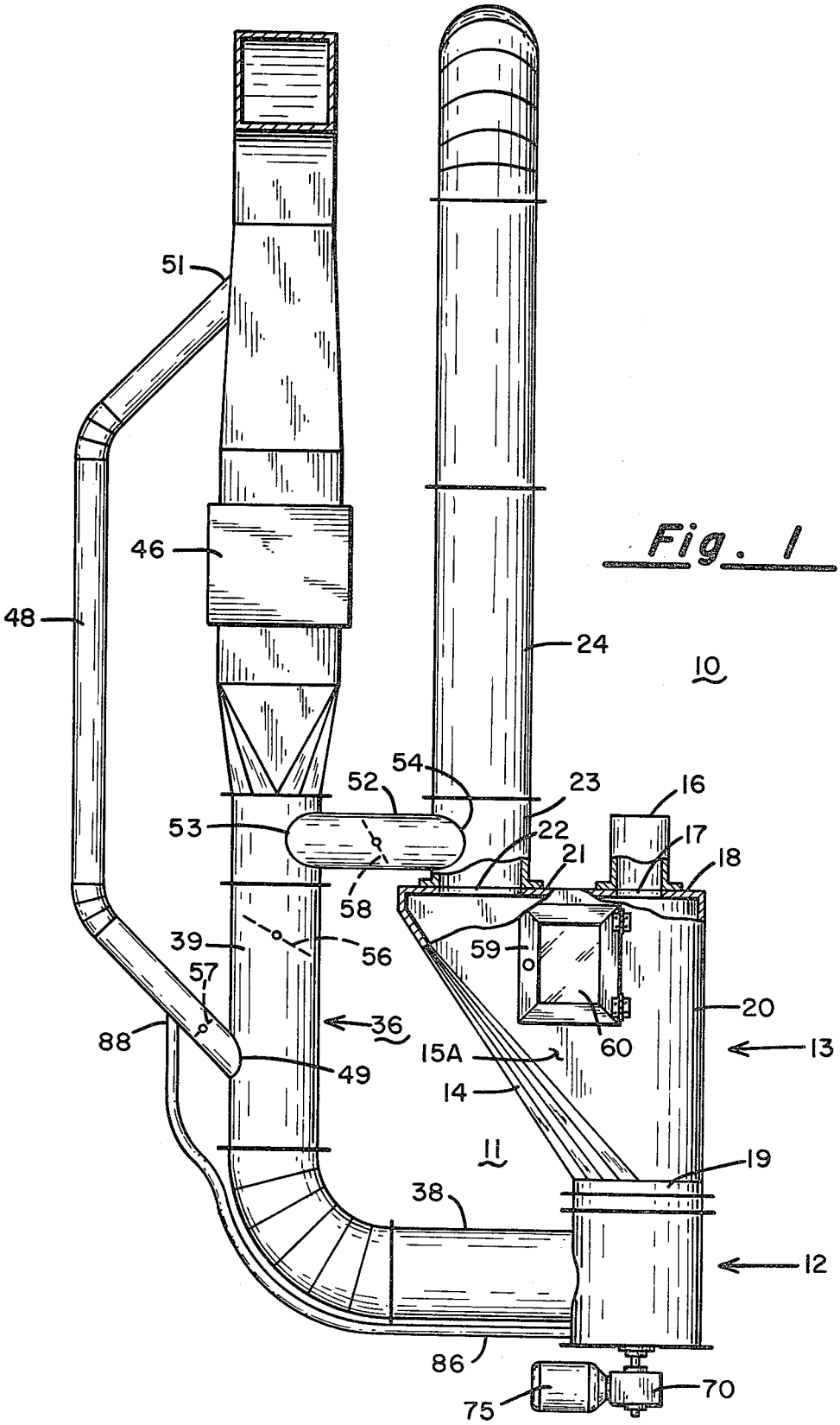
FIG. 1 is a side elevation, with certain portions broken away and other portions shown in section, of a preferred drier unit and system according to the invention.
Figure 5:
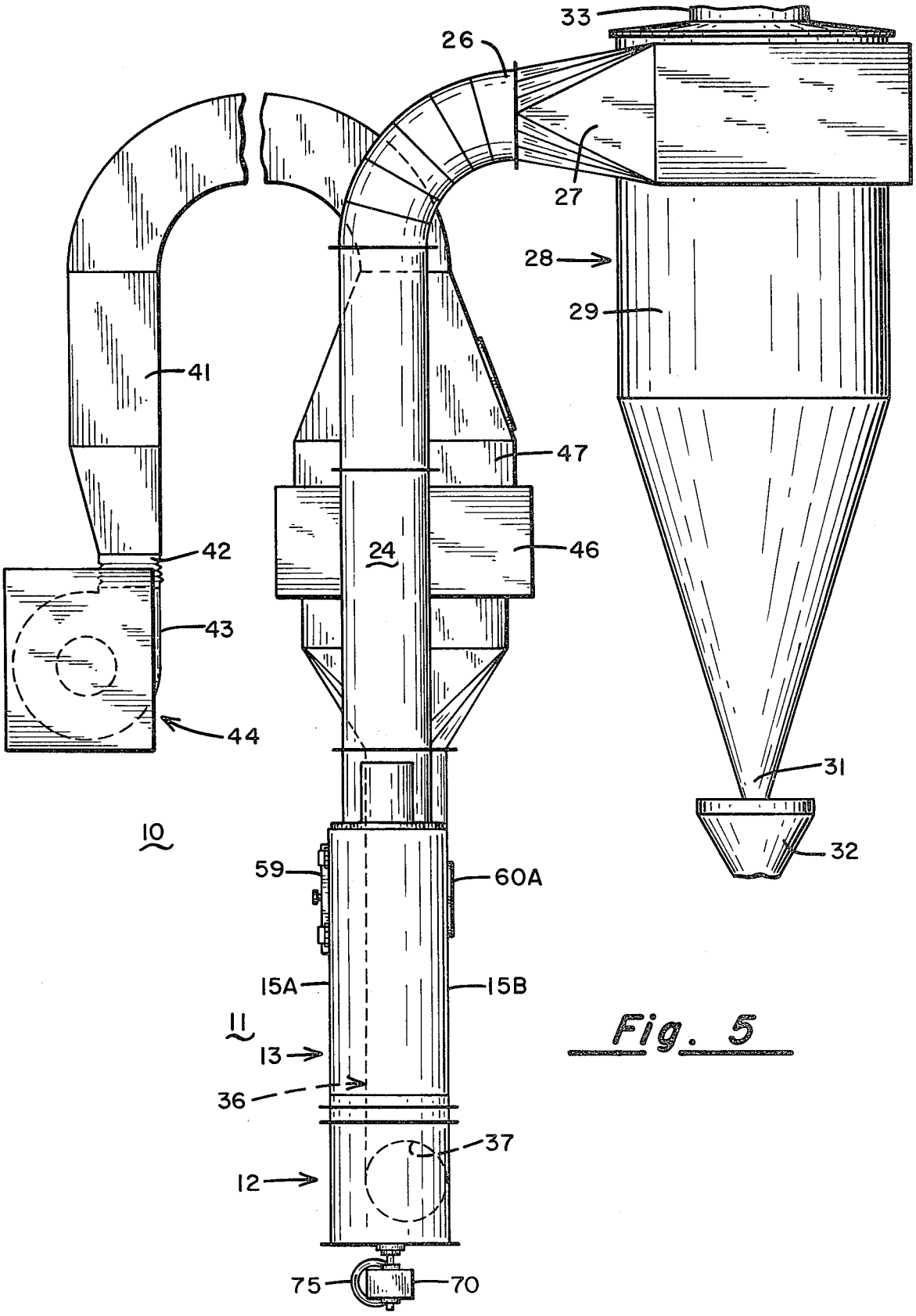
FIG. 5 is an elevation view of the device and system of FIG. 1, as seen from the right of FIG. 1.

As shown in FIGS. 1 and 5, the improved drier of the present invention involves a drier system 10 which includes a main drier unit 11 having a preferably circular bottom plenum chamber 12 from which heated air is fed upwardly to the upper drying and classification chamber 13. Chamber 13 has side wall portions, at least one of which 14 is a sloping side wall portion extending upwardly and outwardly from the bottom of chamber 13 to define a chamber of upwardly increasing or expanding cross section.

A wet or moist solids inlet 16 is adapted to receive the desired materials to be dried directly from a suitable processing unit, such as a centrifuge, and deliver such materials downwardly through a solids inlet opening 17 in the top wall 18 of the drier chamber body.

At the juncture 19 between the bottom plenum chamber 12 and the drier chamber 13, a preferably circular bottom air inlet extending substantially completely across the bottom of chamber 13 provides for the introduction of heated air upwardly from the plenum chamber 12 to engage and at least partially dry the moist particles dropped through the solids inlet opening 17. Such a circular bottom inlet opening at 19 has its central axis extending vertically upwardly through the inlet opening 17, so that materials introduced at the solids inlet will normally drop by gravity directly toward the bottom air inlet opening at 19.

The top wall 18 of the drier body 13 has a laterally outwardly-spaced area 21 provided with a dried material outlet opening 22. Incoming moist solid aggregates or particles which become sufficiently dried or which are sufficiently small to be lifted upwardly and laterally by the flow of heated air from bottom inlet opening 19 to solids outlet 22 will thus be lifted into the bottom end 23 of the vertically upwardly extending pneumatic conveying conduit 24 through which the particles which are light enough and dry enough to reach the outlet opening 22 can then be carried and further dried as they pass through conduit 24 to an outlet end 26 of such conduit, which is connected to the inlet 27 of a suitable separator 28.

Separator 28 is shown as a typical cyclone type separator which includes a cylindrical classifying or separating chamber 29 within which the air and solids materials introduced at 27 can be separated. The separated solids drop by gravity to a separator discharge outlet 31, which may deliver such solids to the hopper 32 of a further conveyer unit, a further processing unit, or a suitable packaging unit. The conveying air from which the solids have been separated is then discharged through a top discharge opening 33, which may be connected to a blower unit (not shown) directly or through an intermediate fine particle filter unit (not shown). The cyclone separator could be replaced by other devices having a suitable separation or classifying chamber. Thus a bag type air filter could be used as the primary collector of dried material. It might also be used as a final fine particle filter for air leaving a discharge outlet such as 33.

A supply of heated air to the bottom plenum chamber 12 of the drier unit 11 is delivered through an air supply conduit 36 which has a discharge opening offset from the vertical center axis of plenum chamber 12 as shown in FIG. 5, for tangential introduction of the air and the desired distribution of such heated air within the plenum chamber, before it passes upwardly through the bottom air inlet opening at 19 and up through the drying and classification chamber 13. The discharge end 37 of the air supply conduit 36 is at the end of a horizontal terminal portion 38 of the supply conduit, which is connected as shown in FIG. 1 to a generally vertical portion 39 of the supply conduit. The opposite or inlet end 41 of the conduit is adapted to receive unheated air through an inlet opening at 42 connected to the outlet 43 of a blower unit 44 (FIG. 5).

An appropriate heating unit 46 is connected at an enlarged intermediate section 47 of the air supply conduit 36 to provide the desired high temperature for the air to be supplied to the drier system. Such heating units are well known and may involve steam heating or other types of heating.

According to a preferred feature of the present invention, a cool air conduit 48 is provided which has its discharge end 49 connected to the hot air supply conduit 36 at a first location shown in FIG. 1 between the heating element 46 and the end 37 of the supply unit which discharges heated air into the plenum chamber 12.

The cooling air conduit 48 provides a means for mixing a desired amount of cooling air with the heated air which has left the heating means 46 and is being fed downwardly through the vertical portion 39 of air supply conduit 36 toward the drier unit. Although it would be possible to introduce cooling air into conduit 48 from some other source, the preferred arrangement is to connect the inlet end 51 to the air supply conduit 36 at an upstream location between the air heating means 46 and the end 41, 42 of the air supply conduit which receives substantially unheated air from blower 44.

A hot air bypass conduit 52 is also provided as shown in FIG. 1. This bypass conduit has a first end 53 connected to the air supply conduit at what might be termed a second location, i.e. a location between the heating means 46 and the first location 49 at which the cooling air conduit delivers cooling air to the air supply conduit 36. The discharge end 54 of the hot air bypass conduit 52 is connected to the lower end 23 of pneumatic conveying conduit 24 at a location close to the solids outlet opening 22 of the drier unit. Thus conveying and drying air of maximum temperature can be supplied at a safe point where the solid particles which have been classified and at least partially dried in the unit 11 will be carried at a rapid rate for a very short interval through the pneumatic conveying conduit 24 to the separator 28. Because of the relatively high conveying speed and the relatively short time involved, the total exposure of the solid particles to these higher temperatures can be carefully controlled without repeatedly subjecting the particles to movement through this high temperature.

To achieve the desired relative temperatures and volume rates of flow for a particular product and to permit selective adjustment of these factors for different products, an adjustable damper means is provided in at least one of the air supply, cool air, and hot air bypass conduits. Thus an adjustable damper 56 is positioned within the vertical section 39 of the hot air supply conduit at a location between the heating means 46 and the first location 49 where the cooling air conduit delivers its cooling air to the vertical conduit section 39.

An adjustable damper 57 is provided in the cool air conduit at a location close to the delivery end 49, in order to avoid a substantial back-up of heated air from the hot air supply conduit 36 into the bypass conduit 48, when damper 57 is closed. An adjustable damper 58 is positioned within hot air bypass conduit 52 to cut off or control the desired relative rate of supply of air of maximum temperature to the lower end of the pneumatic conveying conduit 24. As shown in FIG. 1, both the cool air conduit 48 and the hot air bypass conduit 52 are smaller in cross section than the main air supply conduit 36. The conduit 48 can be relatively small in cross section, since it is used primarily to temporarily reduce the maximum temperature of the air supply delivered by the heating means 46. The bypass conduit 52 may be slightly larger in cross section to ensure delivery, when desired, of an adequate supply of maximum temperature air to the lower end of the pneumatic conveying conduit 24. The relative dimensions of the conduits and the manner in which the adjustable dampers can be set will depend on the nature of the materials treated. There may be applications in which only one adjustable damper is needed, but the preferred embodiment includes an adjustable damper in each of the hot air supply, cool air and hot air bypass conduits.

Figure 2:
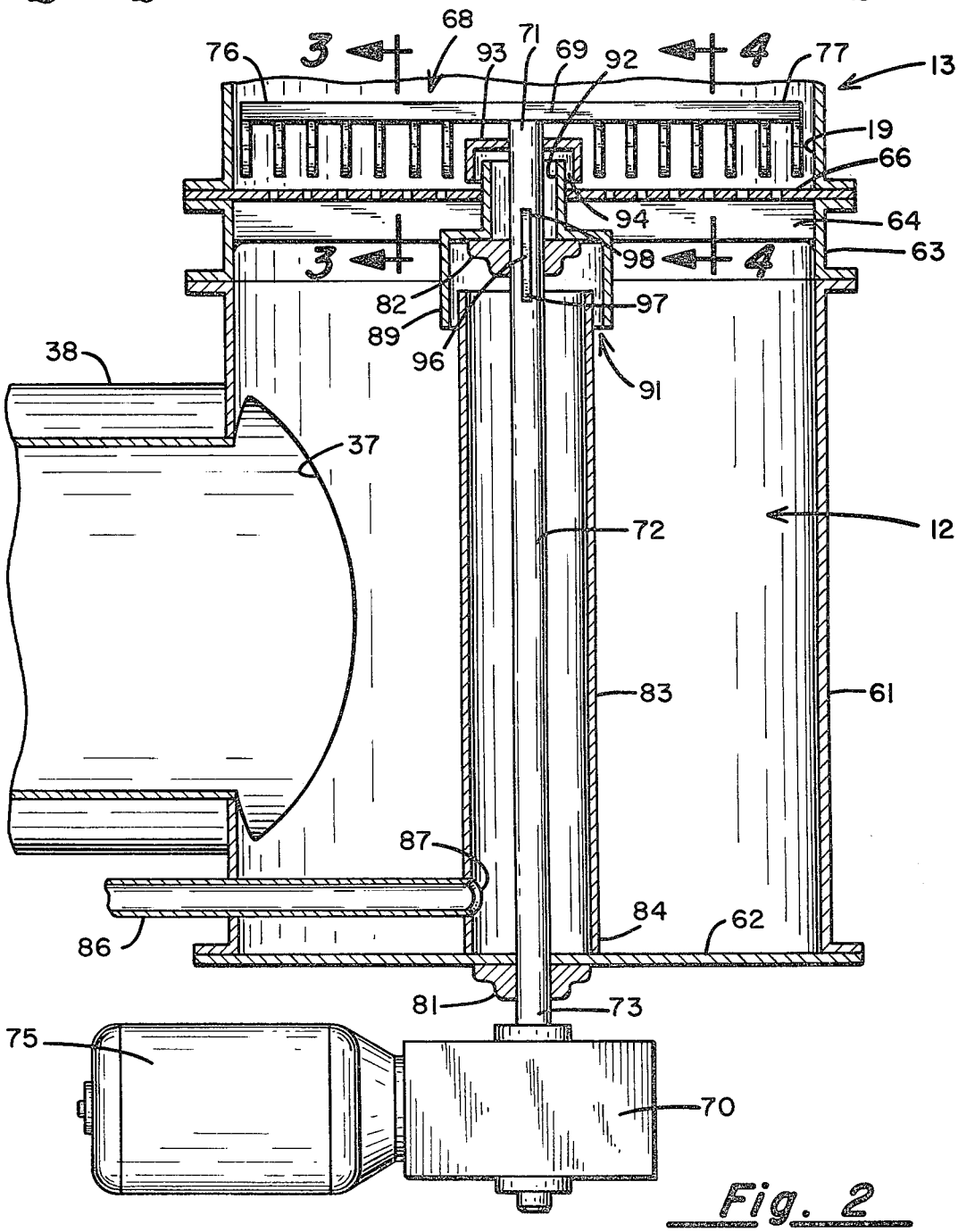
FIG. 2 is an enlarged sectional view showing details of the lower portion of the drier unit of FIG. 1.

FIG. 2 shows further details and features of the preferred construction for the lower portion of the drier unit 11. Thus the preliminary plenum chamber includes a cylindrical side wall 61 which has its cylindrical axis extending vertically and coaxially with the axis of the circular bottom opening at 19 in the upper drying and classifying chamber 13. Plenum chamber 12 has a circular bottom wall 62 and a circular upper supporting frame 63 which supports a plurality of grid members extending across the plenum chamber below the opening 19. Thus the cross members 64 which constitute this grid may be welded at their outer ends to the circular support portion 63. At the top of the plenum chamber the grid members 64 are parallel to each other and are spaced sufficiently apart to provide a reasonably free upward flow of heated air to the upper drier chamber.

Supported at the top of the frame 63 and grid member 64 is a perforated circular bottom plate 66 provided with small openings 67 through which the supply of heated air is fed upwardly at the desired linear velocity uniformly across the bottom opening 19. While the upward velocity of the hot air supply is intended to prevent the build up of a bed of solid materials on the bottom plate 66, a movable rake member 68 is positioned just above the plate 66 to assist in breaking up particles which drop far enough to reach the plate and to help break up any such particles or aggregates which are too large or too moist to become readily partially dried or to be carried upwardly and laterally to the solids outlet opening 22 of the upper chamber.

Figure 3:
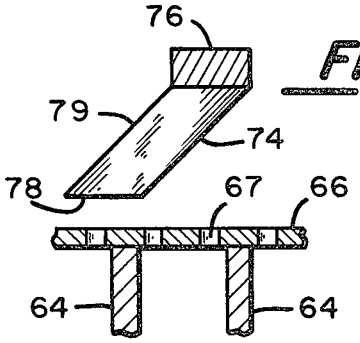
FIG. 3 is a partial sectional view on the line 3—3 of FIG. 2.
Figure 4:
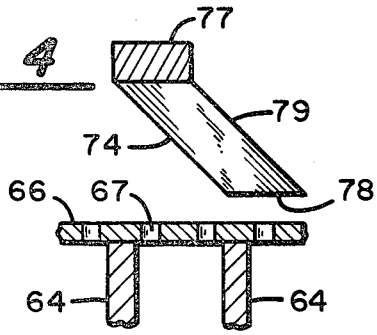
FIG. 4 is a partial sectional view on the line 4—4 of FIG. 2.

Rake member 68 includes a rotary cross bar 69 secured at the upper end 71 of a rotatable vertical rake shaft 72. The lower end of shaft 72 extends downwardly through the bottom wall 62 of the plenum chamber and is connected at 73 to a suitable driving member of a gear box 70 driven by an electrical motor 75. Rotation of vertical shaft 72 thus causes rotation of the rake cross bar 69, which carries downwardly projecting rake teeth 74 as particularly shown in FIGS. 3 and 4. Rake cross bar 69 has one radially extending end portion 76 and an oppositely extending radial portion 77, which together extend diametrically across the space above the perforated plate in opposite directions from the rake shaft. Each of the opposite radial cross bar portions has rake teeth, all of which are inclined angularly forwardly from top to bottom in the direction of rotation of the cross bar. Thus in FIG. 3, the end 76 of the cross bar will normally move circumferentially to the left in that figure and the rake teeth 74 extend angularly and downwardly to the left from their connection to the cross bar portion 76 to a horizontal lower end 78 which is parallel to and closey above the perforated plate 66. The inclination is such that the forward inclined surface 79, as it moves circumferentially around the rake shaft axis, will engage any particles or aggregates in that area with both a circumferential and an upward lifting force to assist both in breaking up the particles and starting them on their way back up through the drying and classifying chamber. In other words, the flat forward surfaces 79 of the rake teeth impart a lifting force component to those particles engaged and broken up by the rake just above the perforated plate 66. While the individual rake teeth are all inclined in the same direction with reference to the common direction of rotation of the respective ends 76 and 77 of rake cross bar 69, they are necessarily oppositely inclined from each other with respect to the cross bar itself, as particularly indicated by FIGS. 3 and 4.

The vertical rotary rake shaft 72 is supported by a sealed lower bearing member 81 secured to the bottom wall 62 of plenum chamber 12. The upper end of the rake shaft is rotatably supported in a sealed upper bearing member 82 secured beneath the grid members 64. To avoid damage to the sealed bearings due to the heated air temperatures within plenum chamber 12, the plenum chamber is further provided with an inner cooling chamber 83 which cylindrically encloses the rake shaft 72 and has its bottom portion 84 covering a wider area of the bottom wall 62 than the area to which lower bearing 81 is secured. Thus the lower end of inner cooling chamber 83 has thermally effective cooling engagement with at least the bottom wall portion above the lower rake shaft bearing.

To supply cooling air to this inner chamber 83, an auxiliary or bypass cooling air supply conduit 86 has its delivery end 87 connected to the lower end of chamber 83. The opposite or inlet end of bypass cooling conduit 86 is connected at 88 (FIG. 1) to the main cooling air bypass conduit 48 at a location upstream from the adjustable damper 57, to ensure that cooling air is fed constantly from conduit 48 through bypass 86 to the inner cooling chamber 83 for the rake shaft bearings.

The upper portion 89 of this inner cooling chamber 83 also has a greater cross section than that of the upper bearing 82, so that the cooling chamber also has effective cooling engagement with the major portion of the upper bearing 82. In order to maintain a circulation of cooling air at this point, a circumferential bleed opening 91 is located close to the upper bearing 82 so that cool air can move upwardly from the inlet 87 to cool both the lower and upper bearings and then to leak at a desired limited controlled rate through the bleed opening 91, where the air will be picked up by the heated air moving up through the plenum chamber 12 to the upper drying chamber.

To keep the air pure and exclude solids from chamber 83 and bearing 82, an extension 92 of chamber 83 projects through the grid members 64 and bottom plate 66 to provide a stationary chamber portion, the top of which is essentially closed by a cylindrical cap member or top which is secured to and rotates with the upper end 71 of the rake shaft 72. A narrow circumferential bleed opening 94 between the stationary and rotary portions at the top of this auxiliary cooling chamber provides for the escape of the cooling air at a controlled rate from this upper chamber. The cooling air may reach the chamber through a suitable passage 96 within shaft 72. The passage has one end 97 opening into the inner cooling chamber below the upper bearing 82 and its other end 98 opening into the upper extension or supplemental cooling chamber above the bearing 82. Air flow at 94 provides a powder seal.

The portion of cylindrical wall 61 of plenum chamber 12 at the right of FIGS. 1 and 2 corresponds in radius and curvature to the horizontally curved or cylindrical side wall portion 20 which extends vertically from one side of the bottom inlet opening 19 to the corresponding side of the solids inlet opening 17 of the upper drier chamber 13, i.e. cylindrically and coaxially halfway around these openings. The sloping side wall portion 14 of the drier chamber extends smoothly upwardly and outwardly from the circular opposite side of the bottom inlet opening. Thus the upper body side wall portions include two parallel, horizontally spaced, triangular vertical side wall portions 15A and 15B connecting curved side wall portion 20 to sloping side wall portion 14 as shown in FIGS. 1 and 5. An access door 59 with window 60 may be provided in wall 15A and an opposite viewing window 60A is shown in wall 15B for conveniently observing the drier operation or cleaning the chamber as desired.

The drying apparatus and system described herein provide flexibility in adaptation of a drying process to many different types of moist particles and aggregates, and particularly in connection with food or similar products in which unduly high temperatures for too long a period of time may seriously damage the product. The invention has particular application to whey systems in which milk sugar lactose can be received at the solids inlet opening of the drier by direct gravity feed from a centrifuge or equivalent separator just above the drier unit. In such an application it is possible to operate at temperatures in the range of 160 to 170 degrees F. as the material leaves the outlet opening at the top of the drier unit and then by the introduction of higher temperature air, the material can be quickly and safely given its final drying in the short interval required to move it pneumatically to the separator 20 by use of temperatures in a range of 180 to 190 degrees F. in the final pneumatic conveying step.

The foregoing specification accordingly sets forth certain preferred embodiments and modifications of the invention and some of the ways in which the invention may be put into practice, including the best mode presently contemplated by the inventor for carrying out this invention. Modifications of the described embodiments, as well as alternate embodiments and devices for carrying out the invention, may also be apparent to those skilled in the art, within the spirit and scope of the following claims:

I claim:

1. A hot air drier for particles and aggregates of moist solids utilizing the upward movement of heated air at a volume rate sufficient to lift partially dried solids of desired particle size through a upwardly expanding cross section chamber and yet insufficient to lift particles of all moisture contents and sizes through the expanding cross section chamber and thereby dropping oversized and undesirably moist aggregates back down through such chamber for further disintegration and drying, said drier comprising a body portion having a bottom air inlet opening, a top wall spaced above the bottom air inlet opening, a moist solids inlet opening directly above the air inlet opening, and body side wall portions extending upwardly from the edges of the bottom opening to the top wall and including at least one sloping side wall portion extending upwardly and outwardly from the bottom opening to an area of the top wall spaced laterally outwardly from the solids inlet opening, thereby defining a drying chamber of upwardly expanding cross section from the air inlet opening to the top wall, said chamber having an upper portion with a solids outlet opening at a location laterally outwardly-spaced, from the moist solids inlet opening and the air inlet opening, a pneumatic conveying conduit extending from the solids outlet opening for conveying selected solids from the upper portion of the drying chamber, when they have reached the desired dryness and particle size, blower means for maintaining a primary flow of heated drying air upwardly through the bottom air inlet, drying chamber, and solids outlet opening and through the conveying conduit at a volume rate providing lateral lifting of at least partially dried and separated solids upwardly through the chamber and outwardly through the solids outlet opening and dropping of undesirably moist and unseparated solids down through the chamber toward the air inlet opening for further drying and particle separation by the heated air entering that opening, said drier also having a rake member movable across said air inlet opening within the chamber for engaging and breaking up dropped solids into particles suitable for air lifting to the solids outlet, and means for moving the rake member across the said air inlet opening while the drier is operating.

2. A hot air drier according to claim 1 in which the body side wall portions define a drying chamber which is asymmetrical with reference to a vertical axis extending through the bottom air inlet opening and moist solids inlet opening.

3. A hot air drier according to claim 2 in which the body side wall portions include one side wall portion curved in horizontal cross section and extending vertically from one side of the bottom inlet opening to the corresponding side of the solids inlet opening, and said sloping side wall portion extends upwardly and outwardly from the opposite side of the bottom inlet opening.

4. A hot air drier according to claim 3 in which the bottom inlet opening is generally circular with reference to a vertical axis extending through the solids inlet opening, said one curved side wall portion extends cylindrically and coaxially halfway around the bottom inlet opening and solids inlet opening, and the body side wall portions include two parallel, horizontally spaced vertical side wall portions connecting the one curved side wall portion to the upwardly and outwardly sloping side wall portion.

5. A hot air drier according to claim 1 having a perforated inlet plate extending generally horizontally across the bottom air inlet opening and having small openings providing uniform upward linear air inlet velocities across the bottom opening and preventing solids from dropping below said plate, said rake member being movable across and above said plate.

6. A hot air drier according to claim 5 in which the bottom air inlet opening and perforated plate are circular and coaxial with reference to a vertical axis extending through the solids inlet opening, the means for moving the rake member includes a vertical rotary rake shaft extending upwardly through the center of the inlet opening and plate, and a driving motor below the drying chamber having a driving connection with the shaft, and in which the rake member is secured to and extends radially from the top of the shaft.

7. A hot air drier according to claim 6 in which said rake member includes a radially extending crossbar spaced above the perforated plate and having a plurality of parallel rake teeth extending downwardly from the crossbar close to the plate and inclined angularly forwardly from top to bottom in the direction of rotation of the crossbar for imparting a lifting force component to particles engaged and broken up by the rake above said plate.

8. A hot air drier according to claim 7 in which the rake member crossbar has opposite radial portions extending diametrically across the space above the perforated plate in opposite directions from the rake shaft and has inclined rake teeth on each of the respective opposite radial crossbar portions, all of which are inclined angularly forwardly from top to bottom in the direct of rotation of the crossbar and are accordingly oppositely inclined with respect to the crossbar itself.

9. A hot air drier for particles and aggregates of moist solids, said drier comprising a body portion having a bottom air inlet opening, a top wall spaced above the bottom air inlet opening and having a moist solids inlet opening directly above the air inlet opening, the bottom inlet opening being generally circular with reference to a vertical axis extending through the solids inlet opening, and side wall portions extending upwardly from the edges of the bottom opening to the top wall and including at least one sloping side wall portion extending upwardly and outwardly from the bottom opening to an area of the top wall spaced laterally outwardly from the solids inlet opening, thereby defining an asymmetrical drying chamber of upwardly expanding cross section between the air inlet opening and the top wall having one horizontally curved side wall portion extending vertically from one side of the bottom inlet opening to the corresponding side of the solids inlet opening and extending cylindrically and coaxially halfway around the bottom inlet opening and solids inlet opening, said sloping side wall portion extending upwardly and outwardly from the opposite side of the bottom inlet opening, and the body side wall portions including two parallel, horizontally spaced vertical side wall portions connecting the one curved side wall portion to the upwardly and outwardly sloping side wall portion, a solids outlet opening in the laterally outwardly-spaced area of the top wall, a pneumatic conveying conduit extending from the solids outlet opening for conveying selected solids from the chamber, blower means for maintaining a primary flow of heated drying air upwardly through the bottom air inlet, drying chamber, and solids outlet opening and through the conveying conduit as a volume rate providing air classification within the chamber and lateral lifting of at least partially dried and separated solids through the chamber and solids outlet opening and dropping of undesirably moist and unseparated solids down through the chamber toward the air inlet opening for further drying and particle separation by the heated air entering that opening, said drier also having a cylindrical bottom plenum chamber below and coaxial with the bottom inlet opening, and a hot air supply conduit having a delivery end extending horizontally and offset from the plenum chamber axis and thereby delivering its hot air supply tangentially inside the bottom plenum chamber.

10. A hot air drier for particles and aggregates of moist solids, said drier comprising a body portion having a bottom air inlet opening, a top wall spaced above the bottom air inlet opening and having a moist solids inlet opening directly above the air inlet opening, and side wall portions extending upwardly from the edges of the bottom opening to the top wall and including at least one sloping side wall portion extending upwardly and outwardly from the bottom opening to an area of the top wall spaced laterally outwardly from the solids inlet opening, thereby defining a drying chamber of upwardly expanding cross section between the air inlet opening and the top wall, a solids outlet opening in the laterally outwardly-spaced area of the top wall, a pneumatic conveying conduit extending from the solids outlet opening for conveying selected solids from the chamber, blower means for maintaining a primary flow of heated drying air upwardly through the bottom air inlet, drying chamber, and solids outlet opening and through the conveying conduit at a volume rate providing air classification within the chamber and lateral lifting of at least partially dried and separated solids through the chamber and solids outlet opening and dropping of undesirably moist and unseparated solids down through the chamber toward the air inlet opening for further drying and particle separation by the heated air entering that opening, said drier also having a perforated inlet plate extending generally horizontally across the bottom air inlet opening and providing upward linear air inlet velocities preventing solids from dropping below said plate, a rake member movable across said plate within the chamber for further separating dropped solids into particles suitable for air classifying and air lifting to the solids outlet, means for moving the rake member across the plate while the drier is operating, the bottom air inlet opening and perforated plate being circular and coaxial with reference to a vertical axis extending through the solids inlet opening, the means for moving the rake member including a vertical rotary rake shaft extending upwardly through the center of the inlet opening and plate, and a driving motor below the drying chamber having a driving connection with the shaft, the rake member being secured to and extending radially from the top of the shaft, said drier also having a cylindrical bottom plenum chamber below and coaxial with and having substantially the same diameter as the bottom inlet opening, said plenum chamber having a bottom wall with a lower bearing member for the rake shaft supported thereon and means supporting an upper rake shaft bearing at the top of said plenum chamber with the rake shaft extending downwardly through and rotatably supported by said upper and lower bearings and with said driving motor located and connected to the rake shaft below said bottom wall, said bottom plenum chamber further having an inner cooling chamber enclosing said rake shaft and having thermally effective cooling engagement with at least the bottom wall portion above the lower rake shaft bearing and a surface of the upper rake shaft bearing and having a cross section greater than that of said bearings, a cooling air supply conduit having a discharge end connected to deliver cooling air to a lower portion of said inner cooling chamber, and at least one bleed opening at an upper portion of said inner cooling chamber discharging used cooling air at a limited rate into the heated air passing upwardly through the plenum chamber and perforated plate.

11. A hot air drier according to claim 10 in which the inner cooling chamber has a first portion enclosing the lower surface of the upper rake bearing and an extension portion projecting above the upper rake bearing around the rake shaft, a rotary cap on the rake shaft closing said extension portion and providing a circumferential bleed opening as a powder seal between the extension portion and cap, and means for feeding some cooling air from the first inner chamber portion to the extension portion.

12. A hot air drier according to claim 11 in which said last-mentioned means comprises a passageway in the rake shaft having openings below and above the upper rake shaft bearing.

13. A hot air drier for particles and aggregates of moist solids, said drier comprising a body portion having a bottom air inlet opening, a top wall spaced above the bottom air inlet opening and having a moist solids inlet opening directly above the air inlet opening, and side wall portions extending upwardly from the edges of the bottom opening to the top wall and including at least one sloping side wall portion extending upwardly and outwardly from the bottom opening to an area of the top wall spaced laterally outwardly from the solids inlet opening, thereby defining a drying chamber of upwardly expanding cross section between the air inlet opening and the top wall, a solids outlet opening in the laterally outwardly-spaced area of the top wall, a pneumatic conveying conduit extending from the solids outlet opening for conveying selected solids from the chamber, blower means for maintaining a primary flow of heated drying air upwardly through the bottom air inlet, drying chamber, and solids outlet opening and through the conveying conduit at a volume rate providing air classification within the chamber and lateral lifting of at least partially dried and separated solids through the chamber and solids outlet opening and dropping of undesirably moist and unseparated solids down through the chamber toward the air inlet opening for further drying and particle separation by the heated air entering that opening, said drier also having an air supply conduit with one end connected to the air inlet opening for delivering heated air to that opening and with a second end receiving substantially unheated air, an air heating means located between the first and second air supply conduit ends, a cool air conduit for selectively introducing cooling air to said air supply conduit at a first location between the air heating means and the drier air inlet opening, and a hot air bypass conduit having a first end connected to the air supply conduit at a second location between the heating means and said first location for receiving fully heated air prior to introduction of any cooling air, said bypass conduit having a second end connected to the pneumatic conveying conduit close to the solids outlet opening of the drier.

14. A hot air drier according to claim 13 in which the cool air conduit has an inlet end connected to the air supply conduit at an upstream location between the air heating means and the end of the air supply conduit which receives substantially unheated air.

15. A hot air drier according to claim 13 having adjustable damper means in at least one of said air supply, cool air, and hot air bypass conduits for controlling the selective delivery and temperature of the air entering the bottom air inlet opening of the drier and the air carrying the selected solids from the drier chamber through the pneumatic conveying conduit.

16. A hot air drier according to claim 15 having adjustable damper means in each of said air supply, cool air, and hot air bypass conduits.

17. A hot air drier according to claim 16 in which the adjustable damper means in the air supply conduit is located between the air heating means and the first location at which the cool air conduit introduces cooling air to the air supply conduit.

18. A hot air drier according to claim 17 in which the cool air conduit has an inlet end connected to the air supply conduit at an upstream location between the air heating means and the end of the air supply conduit which receives substantially unheated air.

19. A hot air drier according to claim 18 having a separator with an inlet, a chamber for separating dried solids from conveying air, an outlet for discharge of dried and separated solids, and an air outlet for discharge of conveying air, and in which the penumatic conveying conduit extends from the solids outlet of the drier to said separator inlet, and said blower means is connected to at least one of said second end of the air supply conduit and said separator air outlet.

20. A hot air drier system for particles and aggregates of moist solids comprising a drier unit having wall portions defining a drier chamber with a moist solids inlet opening, a hot air inlet opening and a solids outlet opening for discharging selected and at least partially dried particles from the chamber, a pneumatic conveying conduit having one end connected to the solids outlet opening for receiving said selected particles and further drying them while they pass through the conveying conduit, an air supply conduit having one end connected to the air inlet opening of the drier unit for delivering heated air to that opening and a second end receiving substantially unheated air, an air heating means located between the first and second air supply conduit ends, a cool air conduit for selectively introducing cooling air to said air supply conduit at a first location between the air heating means and the drier air inlet opening, and a hot air bypass conduit having a first end connected to the air supply conduit at a second location between the heating means and said first location for receiving fully heated air prior to introduction of any cooling air, said bypass conduit having a second end connected to the pneumatic conveying conduit close to the solids outlet opening of the drier, and adjustable damper means in at least one of said air supply, cool air, and hot air bypass conduits for controlling the selective delivery and temperature of the air entering the hot air inlet opening of the drier and the air carrying the selected solids from the drier chamber through the pneumatic conveying conduit.

* * * * *